United States Patent [19]

Morishita et al.

[11] Patent Number: 4,557,022

[45] Date of Patent: Dec. 10, 1985

[54] DRAFTING MEANS FOR TEXTILE MACHINE SUCH AS SPINNING MACHINE

[75] Inventors: Toshio Morishita, Kariya; Yoshiharu Yasui, Toyota; Yoshihisa Suzuki, Chiryu; Kazuo Seiki, Kariya; Haruyoshi Nakamura, Obu, all of Japan

[73] Assignee: Kabushiki Kaisha Toyoda Jidoshokki Seisakusho, Aichi, Japan

[21] Appl. No.: 610,633

[22] Filed: May 16, 1984

[30] Foreign Application Priority Data

May 20, 1983 [JP] Japan ..... 58-89756
May 20, 1983 [JP] Japan ..... 58-89757
May 21, 1983 [JP] Japan ..... 58-76783[U]

[51] Int. Cl.[4] ..... D01H 5/50

[52] U.S. Cl. ..... 19/267; 19/281; 19/295

[58] Field of Search ..... 19/267, 280, 281, 295

[56] References Cited

U.S. PATENT DOCUMENTS

| | | | |
|---|---|---|---|
| 2,466,086 | 4/1949 | Dudley et al. | 19/267 |
| 2,618,026 | 11/1952 | Dawson et al. | 19/267 |
| 2,746,095 | 5/1956 | Dausch | 19/280 |
| 3,412,434 | 11/1968 | Fusaroli | 19/267 |
| 4,187,588 | 2/1980 | Tsukumo | 19/281 |

FOREIGN PATENT DOCUMENTS

| | | | |
|---|---|---|---|
| 1063498 | 8/1959 | Fed. Rep. of Germany | 19/281 |

*Primary Examiner*—Louis K. Rimrodt
*Attorney, Agent, or Firm*—Burgess, Ryan & Wayne

[57] ABSTRACT

A drafting device for a spinning machine, in which a plurality of loading devices for top rollers is provided, by which each top roller is held in a weighting arm in such a state as being displaceable independently from the other roller without disturbing the drafting operation of the other rollers. By this, a yarn piecing operation in a fasciated yarn spinning system can easily be carried out.

6 Claims, 12 Drawing Figures

DRAFTING MEANS FOR TEXTILE MACHINE SUCH AS SPINNING MACHINE

BACKGROUND OF THE INVENTION

1. Field of the Invention

The present invention relates to a drafting means for a textile machine, more particularly to a device for loading a top roller on a bottom roller of a drafting means provided in a textile machine such as a spinning frame or roving frame.

2. Description of the Prior Art

The so-called roller drafting system is widely utilized for textile machines, especially in spinning machines. In the roller drafting system, a plurality of pairs of top and bottom rollers are arranged in such a manner that each downstream pair has a larger peripheral speed than the upstream pair. A fiber bundle such as a sliver or roving is advanced in the downstream direction while nipped between each top and bottom rollers. There, the bundle is attenuated between each adjacent pairs in accordance with the difference between their peripheral speeds.

In the most popular arrangement of spinning machines, a plurality of spinning stations, each comprising a drafting means, are arranged parallel to each other on the machine frame. Each drafting means comprises three bottom rollers, namely, front, middle, and back rollers, common to all of the spinning stations, and, on the front bottom roller, a front top roller, which comprises a set with the front top roller of an adjacent spinning station. The two front top rollers of each set are rotatably supported on a common shaft. The shaft is held by a single loading unit which exerts a loading force on the midportion of the shaft so that the set of top rollers is urged onto the bottom roller. The middle and back rollers each also has a loading unit of the same construction as that of the front top rollers. All the loading units are incorporated in one weighting arm.

A drawback of the above prior art is that the common shaft for the two top rollers of each set tends to incline relative to the axis of the bottom roller when one of the top rollers is forcibly detached from the bottom roller, which state often occurs when the fiber bundle is accidentally wrapped around the periphery of the top or bottom roller or when the widthwise thickness of the fiber bundle varies. This causes a change in the widthwise distribution of the loading force on the other side of the bottom roller and, therefore, the normal drafting operation of this drafting means is disturbed. In addition, since the loading units for each bottom roller are incorporated in one weighting arm, irregular displacement of one top roller influences all the other loading units, aggravating the draft unevenness.

Besides the above problem, particularly in a fasciated yarn spinning system, a top roller in the leading position of a drafting means, namely, a front top roller, has to be positively detached from a front bottom roller when the yarn piecing operation is carried out so as to reversely introduced a yarn end to be pieced into a drafting zone (for example, refer to Japanese Patent Application Nos. 58-65605, 58-52509, 58-52508, and 58-187696). In this case, of course, the drafting operation of the adjacent spinning station is disturbed so far as the conventional loading device is utilized. Therefore, it is strongly desired to provide a loading device in which each top roller in a weighting arm is displaceable without disturbing the operation of the adjacent spinning station.

SUMMARY OF THE INVENTION

It is an object of the present invention to provide a drafting means for a spinning machine in which each top roller in a spinning station is detachable from a bottom roller independently of the adjacent top roller.

It is another object of the present invention to provide drafting means convenient for carrying out yarn piecing in a fasciated yarn spinning system.

These objects of the present invention can be achieved by drafting means comprising a plurality of pairs of top and bottom rollers, the top rollers being urged onto the companion bottom rollers by means of a loading device provided for each two adjacent drafting means, characterized in that at least one top roller is supported by the loading device in such a manner that the top roller can be loaded and unloaded independently from the corresponding top roller in the adjacent drafting means.

BRIEF DESCRIPTION OF THE DRAWINGS

Other objects and features of the present invention will be apparent from the following description of the preferred embodiments of the present invention with reference to the accompanying drawings, wherein.

Through all the drawings, the same reference numerals are used for indicating similar parts.

DESCRIPTION OF THE PREFERRED EMBODIMENTS

For better understanding of the present invention, the prior art will be described with reference to FIGS. 1 and 2.

Figure 1:
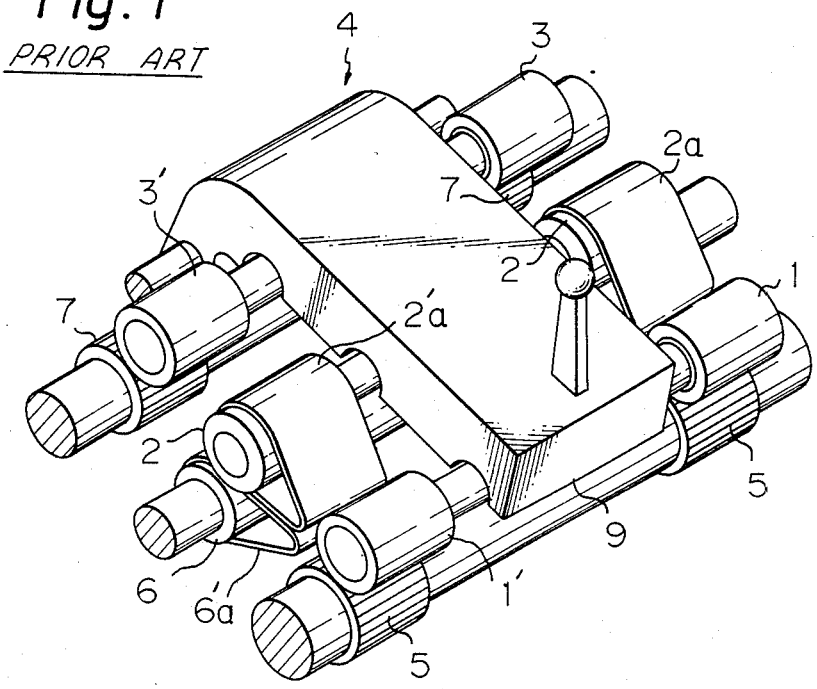
Fig. 1 PRIOR ART
FIG. 1 is a perspective view of a prior art drafting means.
Figure 2:
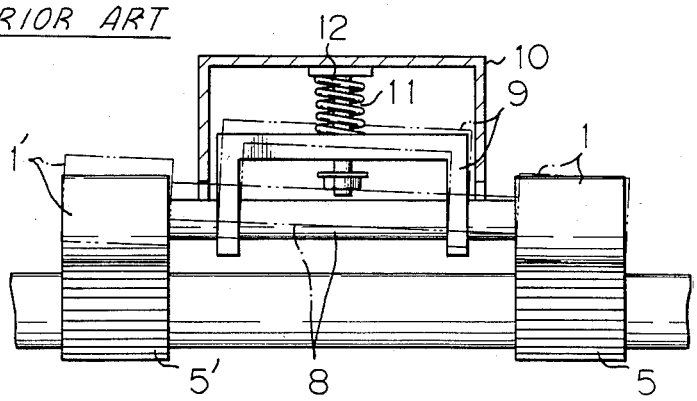
Fig. 2 PRIOR ART
FIG. 2 is a partially sectional front view of the drafting means shown in FIG. 1.

In FIGS. 1 and 2, roller drafting means according to the prior art comprises a front top roller 1, a middle top roller 2 provided with an endless apron 2*a* therearound, and a back top roller 3. Each top roller 1, 2, or 3 for one spinning station is combined with a corresponding roller 1', 2', or 3' for the adjacent spinning station in such a manner that the pairs of rollers 1,1'; 2,2'; or 3,3' are rotatably held on opposite ends of a common shaft 8. The two sets of front rollers 1, 2, 3 and 1', 2', 3' are held on single loading device 4 by which they are simultaneously engageable with or disengageable from a front bottom roller 5, a middle bottom roller 6 provided with an endless apron *6a* therearound, and a back bottom roller 7, respectively.

The top rollers are mounted in the loading device 4 in such a manner that the shaft 8 supporting the pair of top rollers 1,1' (2,2' or 3,3') is held by a U-shaped saddle 9 which is supported by a guide rod 11 projecting from a back surface of a weighting arm 10 of the loading device 4. The saddle 9 is loosely penetrated by the guide rod 11 through a hole provided at a midportion of the saddle 9 and is urged downward by a compression spring 12 provided coaxially with the guide rod 11 between the saddle 9 and the back surface of the weighting arm 10 so that the saddle 9 and, in turn, the top rollers 1,1' are displaceable up and down relative to the loading device 4 along the guide rod 11.

According to the above construction, the shaft 8 supporting the top rollers 1,1' tends to tilt non-parallelly to the companion bottom roller 5 when one of the top rollers 1,1' is detached from the bottom roller 5, as depicted by a chain line in FIG. 2. This results in undesirable draft unevenness not only in the problem spinning station but also in the adjacent station, as stated before.

A first embodiment of the loading device of the present invention will be explained with reference to FIGS. 3 to 6.

Figure 3:
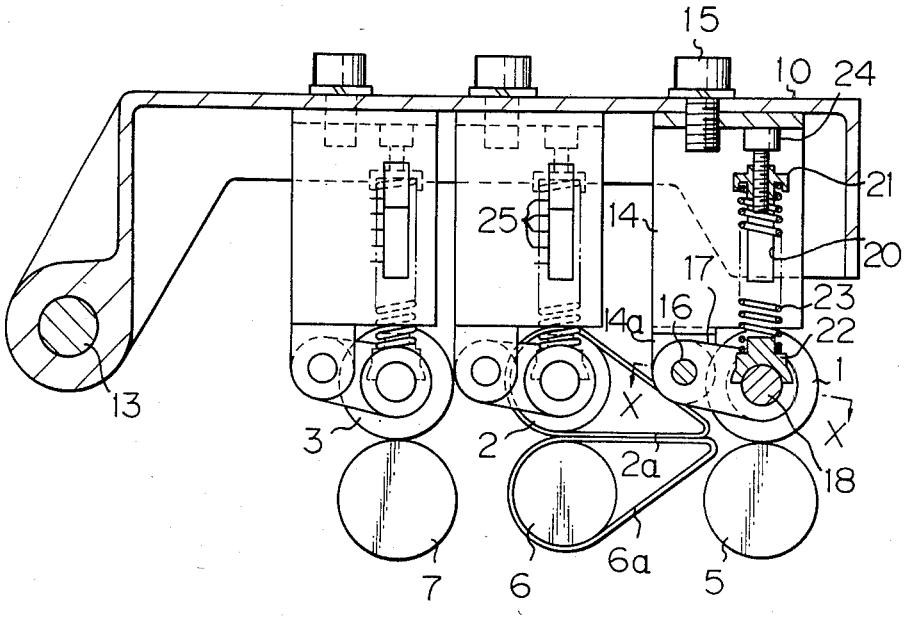
FIG. 3 is a partially sectional side view of a first embodiment of drafting means according to the present invention.

A weighting arm 10 extending over two adjacent drafting means is rotatably pivoted at a base end thereof by a pin 13 and is kept in the operative position illustrated in FIG. 3 by a known hook means (not shown). On a back surface of the weighting arm 10, two sets of three casings 14 are fixed by screws 15 in such a manner that each set is arranged symmetrical to each other relative to a center line of the arm 10. Each set corresponds to one of the two adjacent spinning stations, and each casing 14 corresponds to one of the front, middle, and back top rollers. Since each casing 14 has substantially the same construction, only one of them, i.e., the casing 14 for the front roller, is explained.

Figure 4:
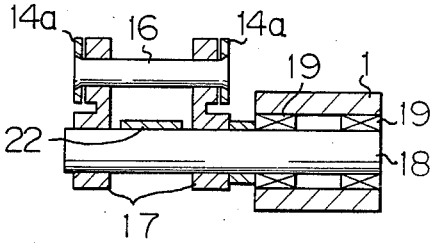
FIG. 4 is a sectional plan view along the X—X plane of FIG. 3.
Figure 5:
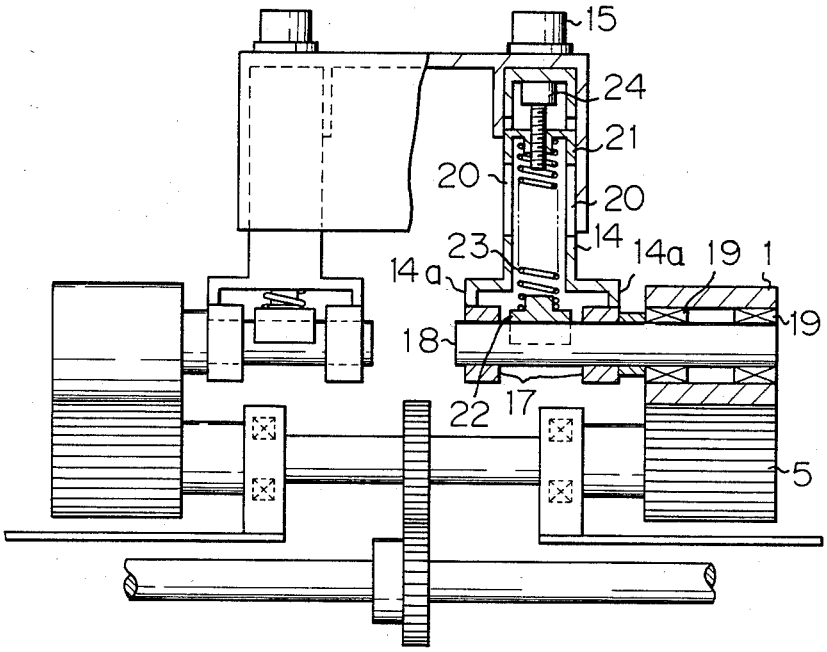
FIG. 5 is a partially sectional front view of the drafting means shown in FIG. 3.

The casing 14 has a pair of downward projections *14a* on opposite side walls thereof, as shown in FIG. 5. The projections *14a* hold therebetween a pin 16, by which a pair of arms 17 are supported so that they are rotatable about the pin 16 in a plane perpendicular to the axes of the front bottom roller 5. The arms 17 carry a shaft 18 at further ends thereof. The shaft 18 rotatably supports a front top roller 1 by means of a bearing 19, as shown in FIG. 4.

On each side wall of the casing 14, an elongated hole 20 extends from the upper to lower portion of the casing 14 to guide an adjustable nut 21 threadingly engaged with an adjustable bolt 24. The bolt 24 is mounted at one end thereof on the back surface of the weighting arm 10 in a rotatable state about its own axis and extends downward therefrom, so that the adjustable nut 21 is displaceable along the hole 20 when the bolt 24 is rotated relative to the nut 21.

An abutment 22 is securedly engaged on the periphery of the shaft 18 and a compression spring 23 is interposed between the adjustable nut 21 and the abutment 22 coaxially with the adjustable bolt 24, whereby the arm 17 is urged to rotate about the pin 16 in a direction so as to press the top roller 1 onto the companion bottom roller 5 (i.e., in the clockwise direction in FIG. 3). Along the elongated hole 20, scale marks 25 are provided for indicating the position of the adjustable nut 21 and, therefore, a length of the spring 23 as a measure of the compressive force between the top and bottom rollers 1 and 5.

Next, the operation of the above device of the present invention will be explained.

Figure 6:
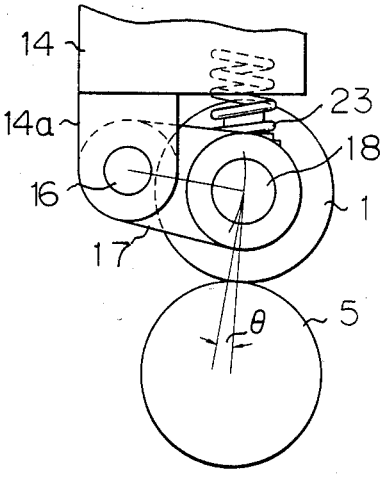
FIG. 6 is an enlarged side view of the drafting means shown in FIG. 3, illustrating an operation thereof.

When the weighting arm 10 is in the operative position shown in FIG. 3, the loading force generated by the compression of the spring 23 is transmitted to the shaft 18 through the abutment 22 and, finally, to the top roller 1. The loading force can be varied by adjusting the length of the spring 23 by rotating the bolt 24 while keeping the nut 21 fixed. The loading force can be predetermined by setting the position of the adjustable nut 21 under visual monitoring of the scale marks 25, so that the proper value is obtained corresponding to the kind of fibers or the thickness of the sliver. Of course, since the weighting arm 10 and the casing 14 have sufficient rigidity against the reaction for the spring force, the position of the pin 16 does not move by the above reaction. The arm 17 supporting the shaft 18 is rotated in the plane perpendicular to the bottom roller 5, whereby the top roller 1 is always kept parallel to the bottom roller 5 even when the distance between the top and bottom rollers 1 and 5 varies. Accordingly, the widthwise distribution of the loading force between the top and bottom rollers is maintained uniform. Further, according to the above embodiment, as best seen in FIG. 6, since the straight line connecting the axes of the top and bottom rollers 1 and 5 and another straight line perpendicular to a line connecting the axes of the top roller 1 and the pin 16, (the latter line corresponding to the direction of the loading force) make a relatively small angle $\theta$ in the operative position, the loading force does not vary much even if the top roller 1 moves from the bottom roller 5 due to the thickness variance of the fiber bundle to be drafted. This ensures uniform drafting effect over the width of the fiber bundle and, as a result, a good yarn quality.

Figure 7:
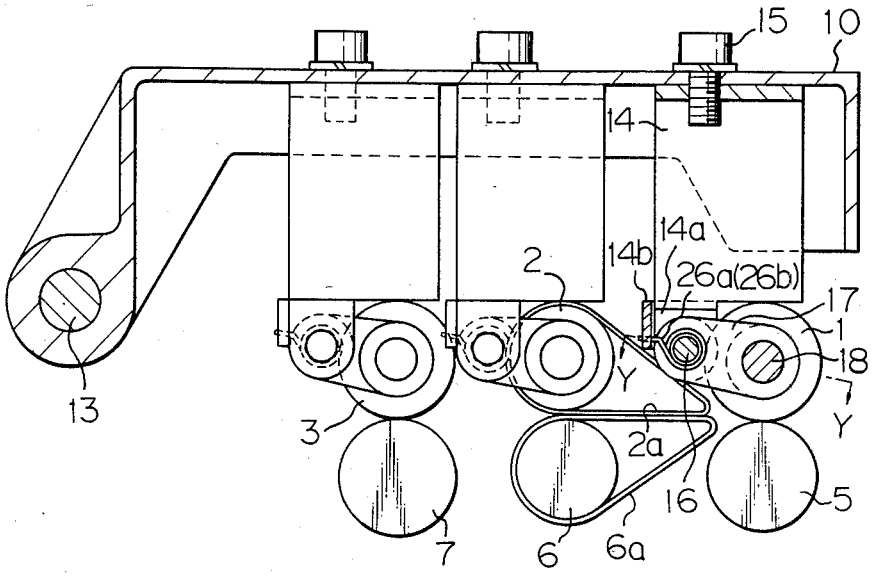
FIG. 7 is a partially sectional side view of a second embodiment of drafting means according to the present invention.
Figure 8:
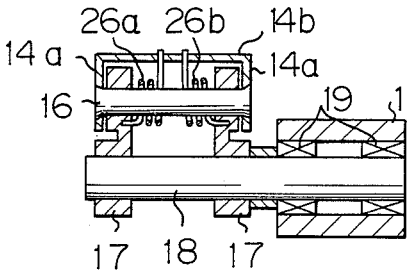
FIG. 8 is a sectional plan view along the Y—Y plane of FIG. 7.

A second embodiment of the loading device according to the present invention is shown in FIGS. 7 and 8. This embodiment differs from the first embodiment only regarding the spring means generating the loading force. That is, instead of the compression spring 23 and the adjustable bolt 24 and nut 21 of the first embodiment, there is provided a pair of torsion springs *26a* and *26b* around a pin 16 which pivotally supports a pair of arms 17 carrying a shaft 18 for a top roller 1. One end of the torsion spring *26a* or *26b* is engaged in a hole provided on an inside wall of the arm 17, and the other end thereof is hooked to a rearside wall *14b* of a casing 14 so that the arm 17 can be urged to rotate in the direction to press the top roller 1 onto the bottom roller 5.

Figure 9:
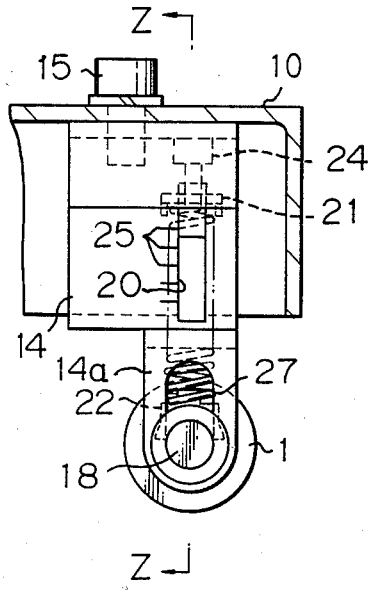
FIG. 9 is a sectional side view of a part of a third embodiment of drafting means according to the present invention.
Figure 10:
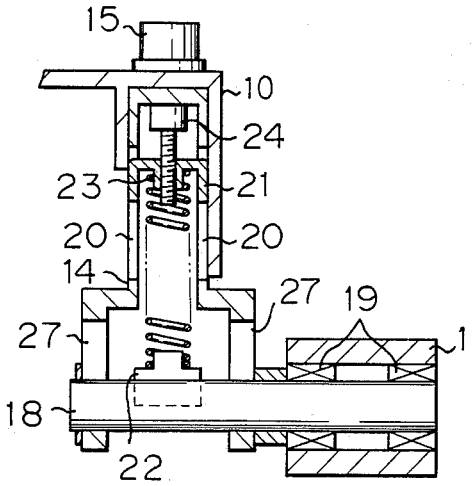
FIG. 10 is a sectional front view along the Z—Z plane of FIG. 9.

A third embodiment of the loading device according to the present invention is shown in FIGS. 9 and 10. In this embodiment, the pin 16 and the pair of arms 17 of the first embodiment are omitted. A shaft 18 carrying a top roller 1 is supported in a pair of elongated holes 27 provided on a pair of projections *14a* and is displaceable therealong under direct action of a compression spring 23.

As stated before, in the yarn piecing operation of a fasciated yarn spinning system, the top roller in the leading position sometimes is lifted up from the bottom roller. The loading device according to the present invention solves the problems attendant with this, because each top roller is supported on the weighting arm independently from each other so that the lift-up motion of one top roller exerts no action on the other.

One embodiment of a roller lift-up mechanism is described below with reference to FIGS. 11 and 12.

The roller lift-up mechanism comprises a lifting lever 121 mounted on a machine frame of a spinning machine in front of a front bottom roller 5 by a pin 120 in a rotatable state about the pin 120 in a plane perpendicular to the axis of the bottom roller 5. The lifting lever 121 has an operating end 121*a* at a front end thereof which normally contacts the underside of a shaft 18 carrying a front top roller 1. At the opposite end of the lifting lever 121 beyond the pin 120, a foot 121*b* is provided for receiving a driving force. Drafting means including a loading device of the same construction as the first embodiment shown in FIGS. 3 to 6 is provided.

Figure 11:
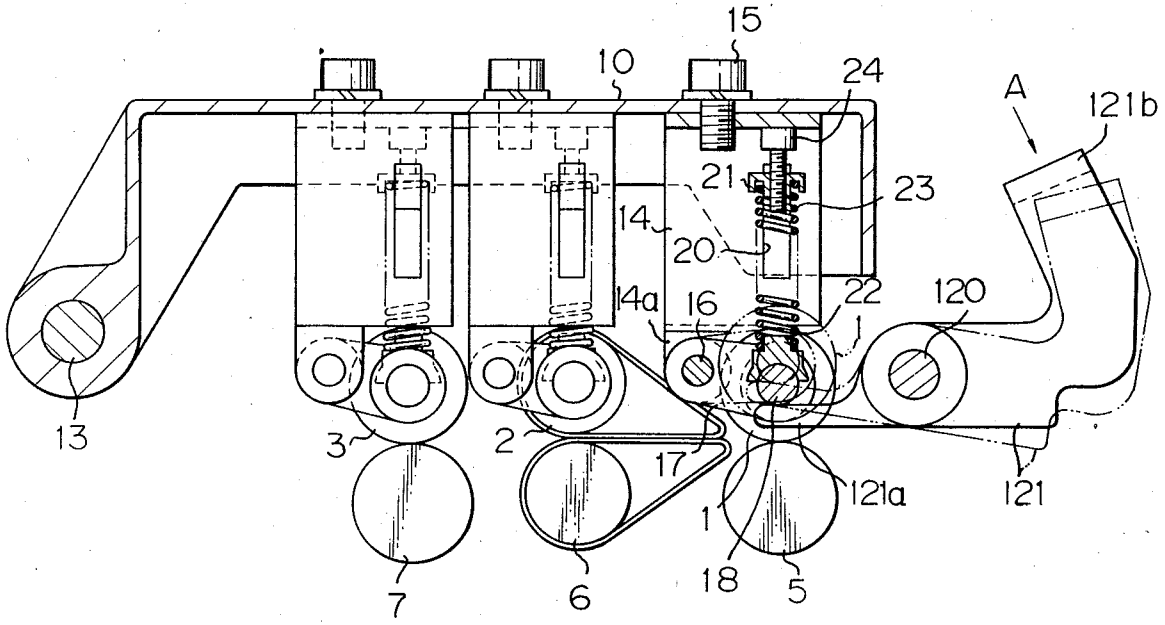
FIG. 11 is a view similar to FIG. 3, illustrating the operation of a roller lift-up mechanism according to the present invention.
Figure 12:
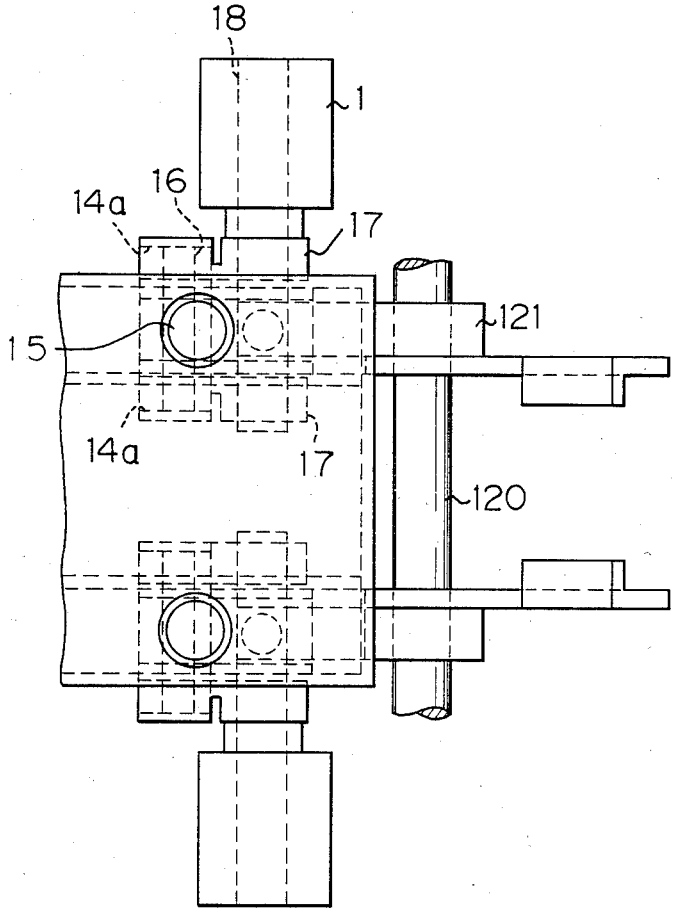
FIG. 12 is a plan view of the roller lift-up mechanism shown in FIG. 11.

In the normal spinning operation of the spinning station, the lift-up mechanism and the front top roller 1 occupy a position, depicted by the solid line in FIG. 11. When a yarn piecing operation is required, the foot 121*b* of the lever 121 is pushed by a pushing means provided in an automatic yarn piecer (not shown) in the direction shown by the arrow A. Then, the lever 121 is rotated about the pin 120 in the clockwise direction in FIG. 11, whereby the shaft 18 and, in turn, the top roller 1, are lifted up overcoming the compressive force of the spring 23, as shown by a chain line. This creates a gap between the front top and bottom rollers 1 and 5, through which the yarn to be pieced can be introduced into the drafting means. When the pushing force is released from the foot 121*b*, the front top roller 1 and the lever 121 return to the initial position indicated by the solid line and the yarn is nipped by the front top and bottom rollers 1 and 5. Of course, the lever 121 can be manually operated when the top roller 1 has to be removed from the shaft 18, such as in the case where the top roller is damaged.

We claim:

1. In a textile machine comprising a spinning machine, said spinning machine comprising a plurality of spinning stations, drafting means for said spinning stations comprising a plurality of pairs of top and bottom rollers, each top roller being grouped in a pair with a corresponding top roller for the adjacent drafting means and urged toward a companion bottom roller by means of a loading device provided for every two adjacent drafting means, characterized in that said pair of top rollers is supported in said loading device in such a manner that said top roller can be loaded and unloaded independently from the corresponding top roller of the adjacent drafting means.

2. A drafting means according to claim 1, wherein said loading device comprises a weighting arm extending over said two adjacent drafting means and holding a shaft of said top rollers of said drafting means; said weighting arm comprising casings, each for mounting a spring means for generating a loading force on said top roller.

3. A drafting means according to claim 2, wherein a pair of arms is pivotally mounted in said casing for supporting said shaft of said top roller.

4. A drafting means according to claim 3, wherein said spring means comprises a torsion spring for urging said pair of arms to rotate.

5. A drafting means according to claim 2, wherein said spring means comprises an abutment fixedly mounted on the periphery of said shaft, a pair of an adjustable nut and bolt secured on said casing and a compression spring interposed between said abutment and said adjustable nut.

6. A lift-up mechanism for detaching a leading top roller from a companion bottom roller of a drafting means according to claim 1, comprising a lifting lever pivoted on the machine frame in front of said drafting means, said lifting lever being operated manually or by a yarn piecer to lift up said shaft of said top roller.

* * * * *